US011321992B2

(12) United States Patent
Bussey et al.

(10) Patent No.: US 11,321,992 B2
(45) **Date of Patent: *May 3, 2022**

(54) GAMING MACHINE BUTTON DECK FILLER WITH LIGHTING EFFECTS

(71) Applicant: Everi Games, Inc., Austin, TX (US)

(72) Inventors: Travis B. Bussey, Austin, TX (US); Daniel C. Gibson, Austin, TX (US); Craig Steven Gallagher, Austin, TX (US); Peter A. Phillips, Jr., Austin, TX (US)

(73) Assignee: Everi Games, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/939,850

(22) Filed: Jul. 27, 2020

(65) Prior Publication Data

US 2020/0357223 A1 Nov. 12, 2020

Related U.S. Application Data

(63) Continuation of application No. 16/148,975, filed on Oct. 1, 2018, now Pat. No. 10,726,660.

(60) Provisional application No. 62/567,219, filed on Oct. 2, 2017.

(51) Int. Cl.
*G07F 17/32* (2006.01)

(52) U.S. Cl.
CPC ..... *G07F 17/3211* (2013.01)

(58) Field of Classification Search
CPC ..... G07F 17/3211; G07F 17/3216
See application file for complete search history.

(56) References Cited

U.S. PATENT DOCUMENTS

| | | | |
|---|---|---|---|
| 4,614,342 | A | 9/1986 | Takashima |
| 5,289,924 | A | 3/1994 | Takemoto |
| 6,572,204 | B1 | 6/2003 | Hedrick |
| D529,101 | S | 9/2006 | Kaminkow |
| 2006/0046821 | A1 | 3/2006 | Kaminkow |
| 2011/0118034 | A1 | 5/2011 | Jaffe |
| 2013/0130809 | A1 | 5/2013 | Bruzzese |
| 2014/0309029 | A1 | 10/2014 | Schrementi |
| 2015/0269808 | A1 | 9/2015 | Cornell |

*Primary Examiner* — David L Lewis
*Assistant Examiner* — Shauna-Kay N Hall
(74) *Attorney, Agent, or Firm* — Nathan H. Calvert; The Culbertson Group, P.C.

(57) ABSTRACT

Gaming machine button decks are connected with a button deck filler for connecting between two adjacent gaming machines to provide continuity between button decks and to provide lighting effects between the gaming machines. Light sources may be controlled by a multimedia server operating to control various presentation interfaces for a group of adjacent gaming machines.

19 Claims, 10 Drawing Sheets

GAMING MACHINE BUTTON DECK FILLER WITH LIGHTING EFFECTS

CROSS REFERENCE TO RELATED APPLICATIONS

This application is continuation of U.S. patent application Ser. No. 16/148,975, filed Oct. 1, 2018, entitled "Gaming Machine Button Deck Filler With Lighting Effects," which application claims the benefit, under 35 U.S.C. § 119(e), of U.S. Provisional Patent App. No. 62/567,219 filed Oct. 2, 2017 and entitled "Gaming Machine Button Deck Filler With Lighting Effects." Both of these prior applications are hereby incorporated herein by reference for all purposes. This application is also related to U.S. patent application Ser. No. 15/716,017 filed Sep. 26, 2017 and entitled "Gaming Machine," which application is hereby incorporated herein by reference for all purposes.

TECHNICAL FIELD OF THE INVENTION

The invention relates to gaming machines, and, more particularly, arrangements for connecting between two adjacent gaming machines.

BACKGROUND

Many different types of gaming machines have been developed to provide various formats and graphic presentations for conducting games and presenting game results. For example, numerous mechanical reel-type gaming machines, also known as slot machines, have been developed with different reel configurations, reel symbols, and paylines. Such gaming machines are typically deployed on a casino floor or other gaming area in which optimal use of space is important for gamer comfort and casino revenues. It is noted that traditional upright gaming machines are housed in cabinets that are approximately 19 to 21⅜ inches wide. Pedestal-mounted versions of traditional upright gaming machines are typically operated on pedestals approximately 28 inches wide. The machines are often deployed in rows of back-to-back machines, or in circular groups of three or more machines, often five, with the machine backs facing each other.

Gaming machines often have a "button deck" or ledge extending from the cabinet and carrying buttons and controls at a level comfortable for players to operate them. Such button decks often have padding and cup holder areas.

SUMMARY

Gaming machine button decks are connected with a button deck filler for connecting between two adjacent gaming machines to provide continuity between button decks and to provide lighting effects between the gaming machines. Light sources may be controlled by a multimedia server operating to control various presentation interfaces for a group of adjacent gaming machines.

According to one aspect of the invention, a button deck filler assembly adapted to be connected between adjacent gaming machines. The assembly includes a top portion adapted to, when installed, fill a span between respective button decks of adjacent gaming machines placed with their front faces at a diverging angle, and a base portion below the top portion and adapted to, when installed, fill a span between the gaming machines. A light source is attached to the assembly and operable to produce a light effect visible as light emitting from the button deck filler assembly, the light source comprising an RGB adjustable light. A driver is coupled to the light source, and a controller coupled to the driver and operable to connect to a network, receive instructions from the network associated with the light effect, and in response, operate the driver to cause the light to produce the light effect. In some versions, the network is coupled to a local area network on which the gaming machines are coupled (EGM LAN), and adapted to communicate on the EGM LAN with the gaming machines and other network nodes.

According to another aspect of invention, a gaming multimedia system is provided, including a plurality of gaming machines connected on a gaming machine local area network (EGM LAN) and arranged in a pattern with front faces pointing at diverging angles from adjacent gaming machines in the pattern. Button deck filler assemblies adapted to be installed between respective adjacent pairs of gaming machines. Each filler assembly includes a top portion adapted to, when installed, fill a span between respective button decks of adjacent gaming machines, a base portion below the top portion and adapted to, when installed, fill a span between the gaming machines; and a light source attached to the assembly and operable to produce a light effect visible as light emitting from the button deck filler assembly. A driver is coupled to the light sources of the button deck filler assemblies, and a controller adapted to be coupled to the driver and operable to couple to a multimedia server, receive instructions associated with the light effect from the multimedia server, and operate the driver to cause the light sources to produce the light effect. The light sources may be RGB adjustable light sources. The multimedia server may be coupled to the EGM LAN with the gaming machines and other network nodes, and operable to receive instructions from the gaming machines and other nodes on the EGM LAN.

Different features may be included in different versions of the invention. These and other advantages and features of the invention will be apparent from the following description of the preferred embodiments, considered along with the accompanying drawings.

DESCRIPTION OF REPRESENTATIVE EMBODIMENTS

Figure 1:
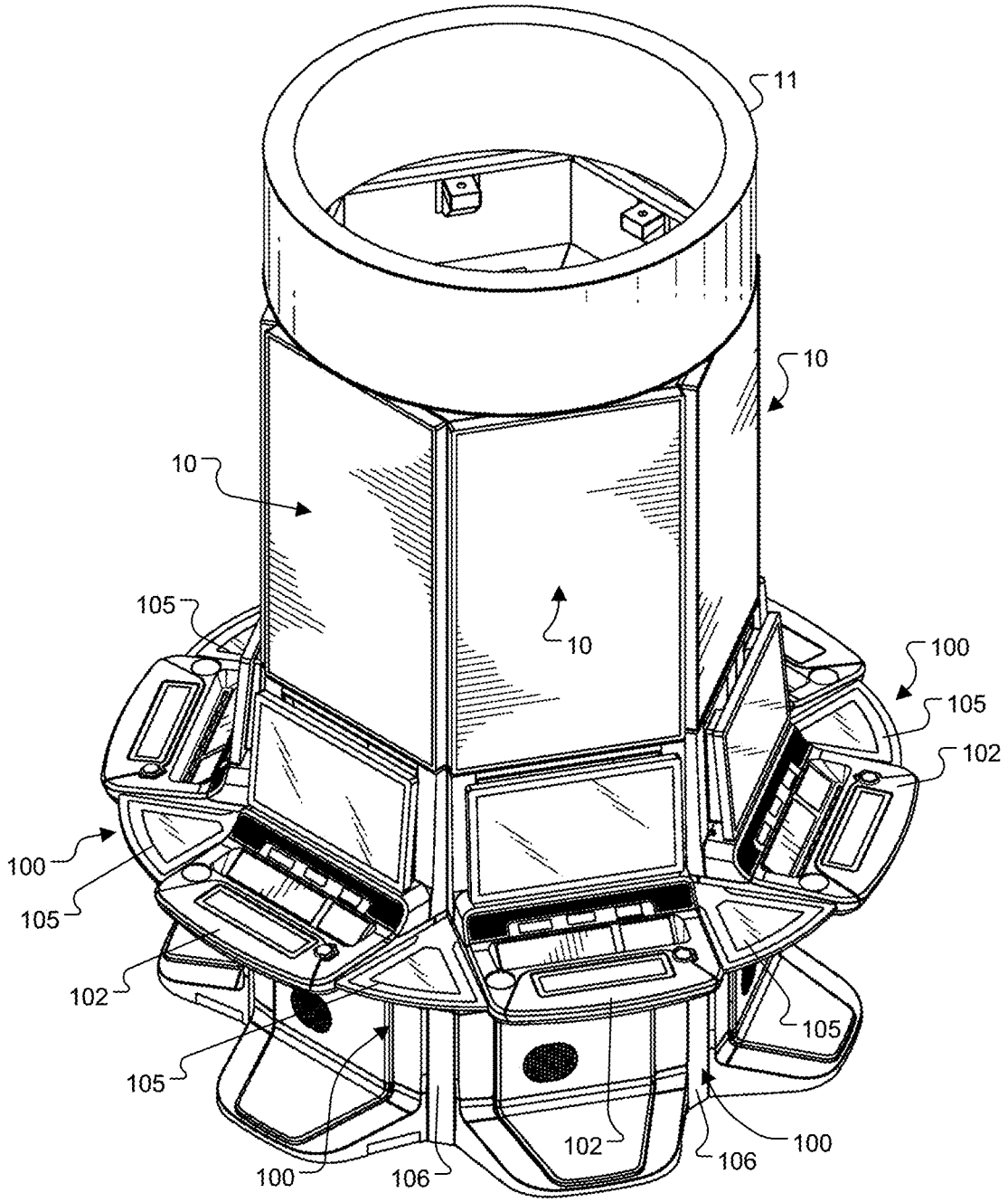
FIG. 1 is a view in perspective of a bank of gaming machines with a button deck filler according to aspects of the present invention.

FIGS. 1 through 7 illustrate aspects of a button deck filler 100 for gaming machines according to one embodiment of the present invention. Button deck filler 100 is adapted to be connected between adjacent gaming machines 10 and particularly the button decks 102 of adjacent gaming machines 10, for example as shown between adjacent pairs of gaming machines in FIG. 1. In this example, a group of six gaming machines 10 are arranged in a hexagonal pattern and have a group display 11 resting atop the group. Other arrangement of gaming machines placed at other angles to each other may also use button deck fillers according to the disclosure herein. The illustrated button deck filler 100 includes a top part 105 and a base part 106.

Figure 2:
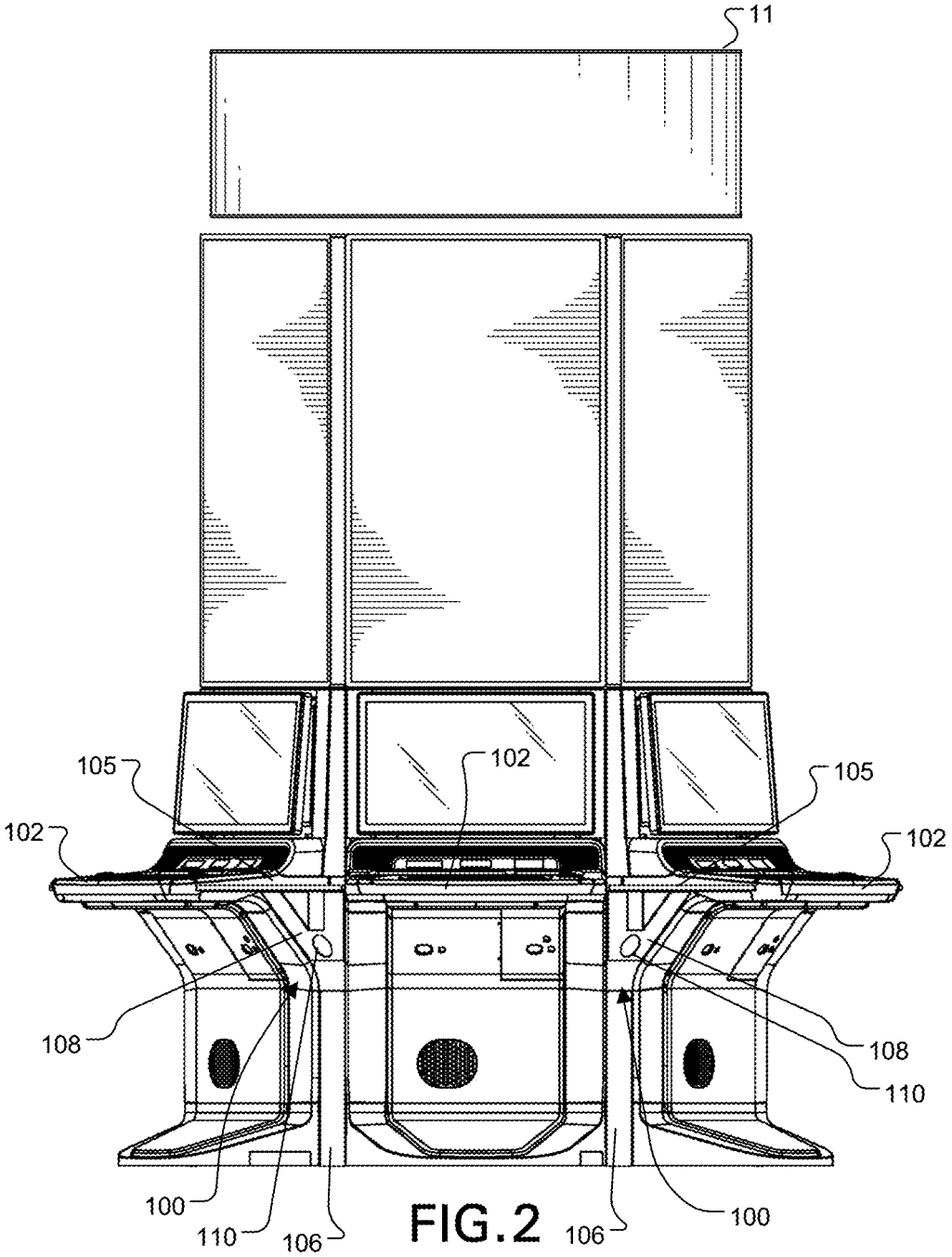
FIG. 2 is a front view of the bank of gaming machines shown in FIG. 1.
Figure 3:
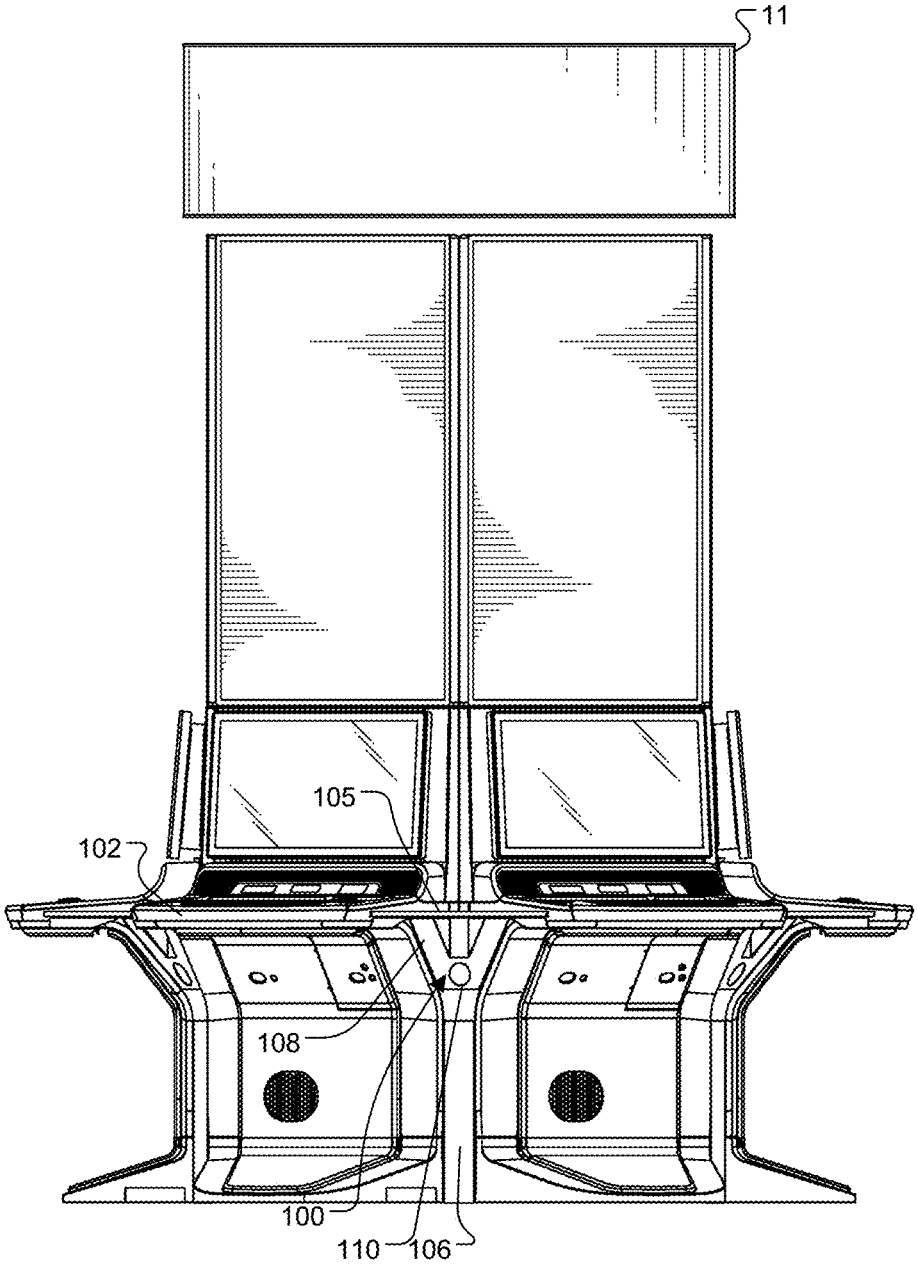
FIG. 3 is a side view of the bank of gaming machines shown in FIG. 1.
Figure 4:
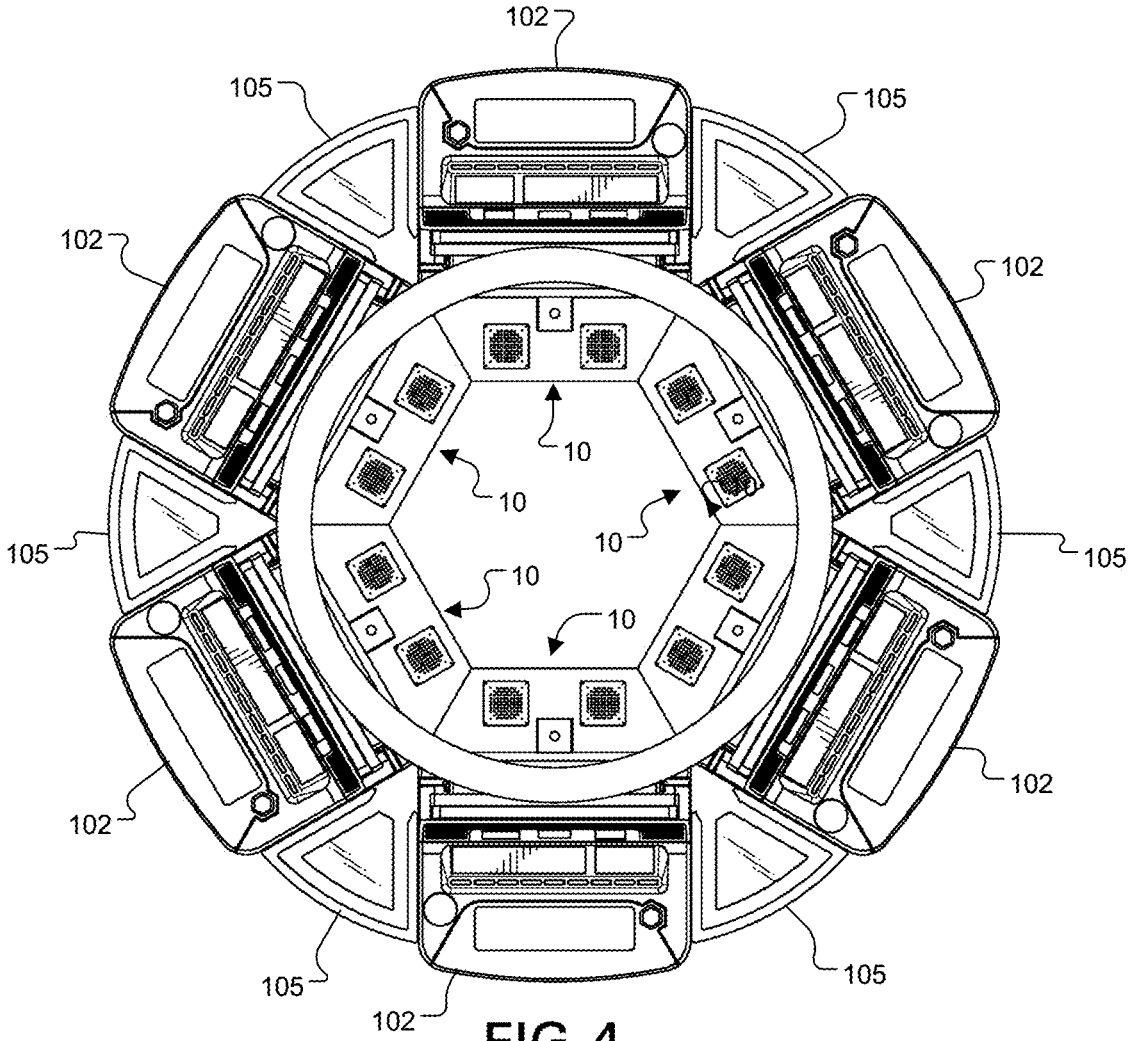
FIG. 4 is a top plan view of the bank of gaming machines shown in FIG. 1.
Figure 5:
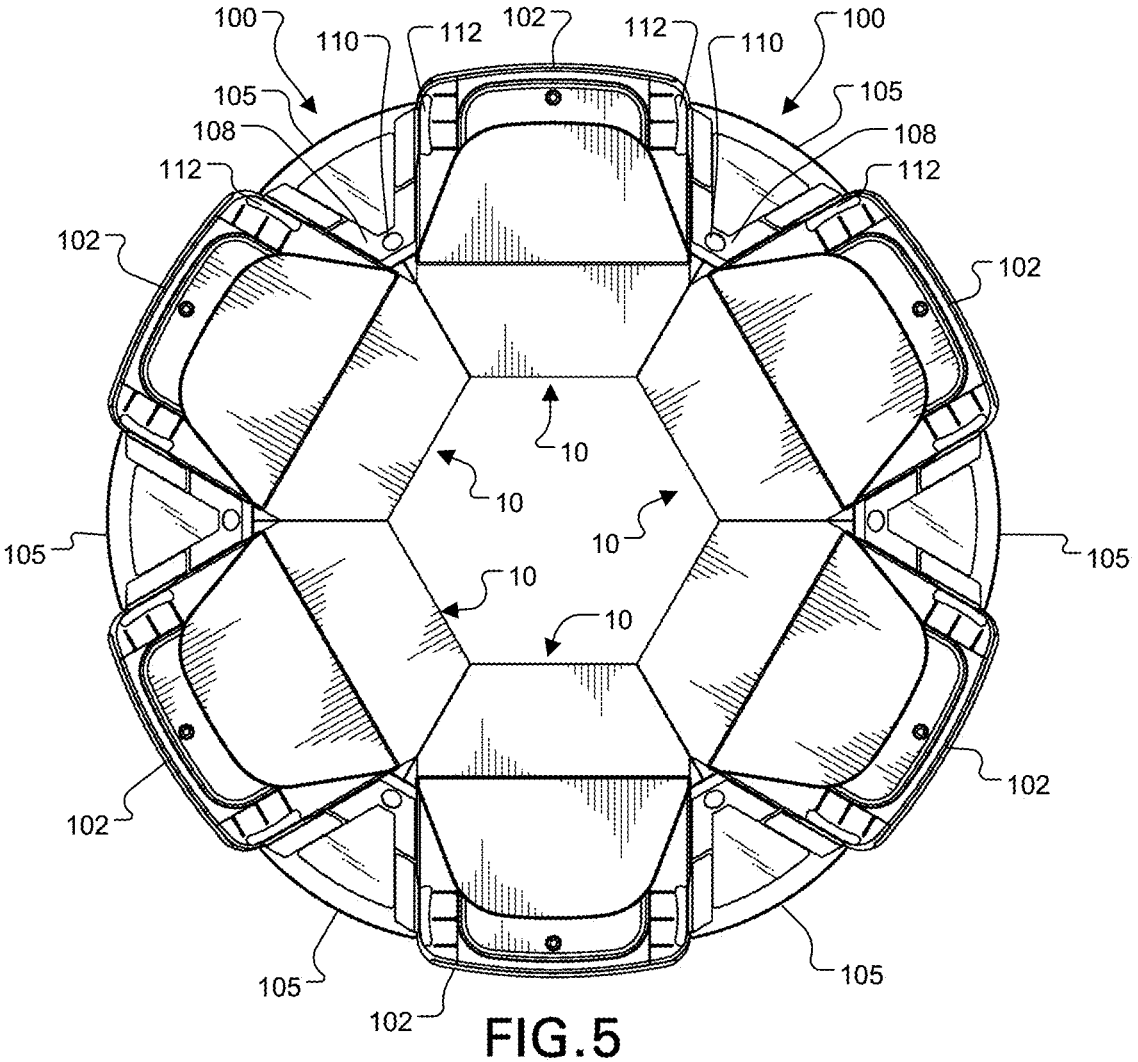
FIG. 5 is a bottom plan view of the bank of gaming machines shown in FIG. 1.
Figure 6:
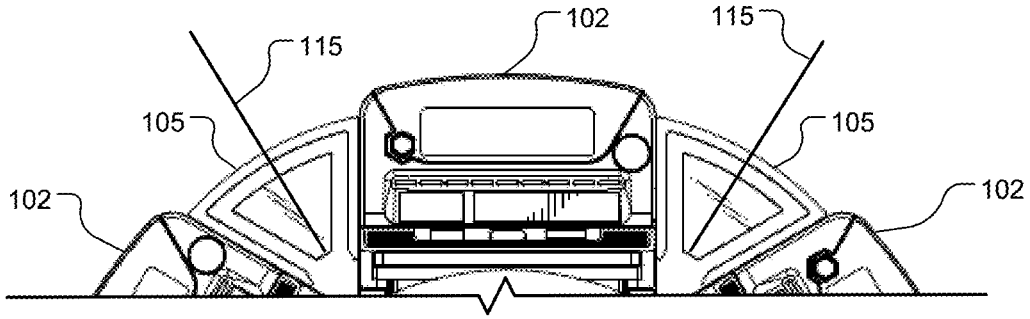
FIG. 6 is a partial top plan view showing the line of a lighting effect provided by the button deck filler according to aspects of the invention.
Figure 7:
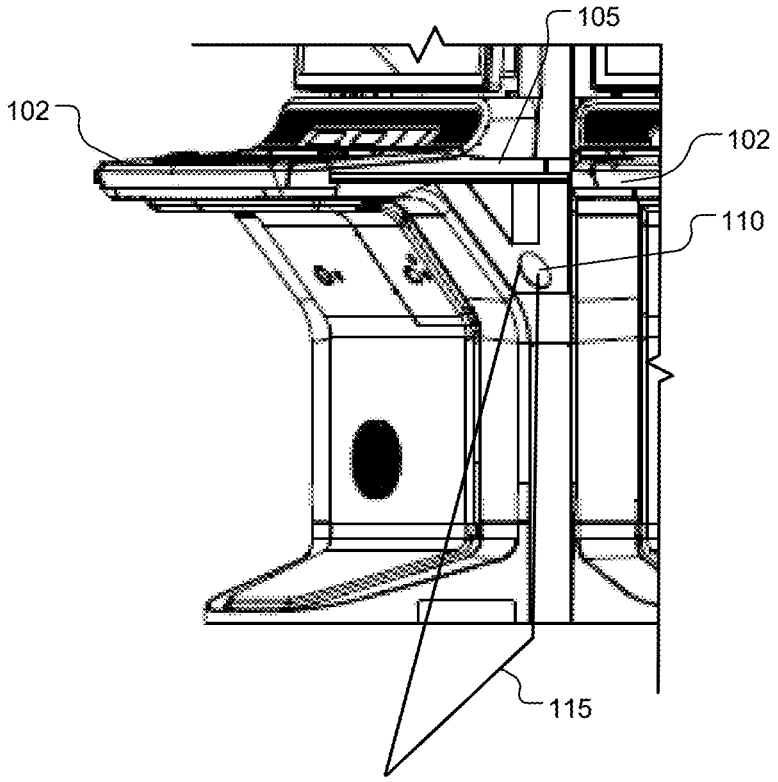
FIG. 7 is a representation of a lighting effect which may be provided by the light sources included in button deck filler shown in FIGS. 1-5.

As shown particularly in FIGS. 2, 3, and 5, button deck fillers 100 also include an upper housing 108 which houses a light source 110. As is apparent particularly from the view of FIGS. 2 and 3, upper housing 108 is at a downward angle which places the light source 110 directed downwardly between adjacent gaming machines. FIGS. 6 and 7 show representations of the adjustable light effect or pattern 115 which may be provided by each light source 110. The light effect or pattern 115 extends outwardly from light source 110 between each adjacent gaming machine.

The bottom view of FIG. 5 shows that each button deck filler 100 may include two supporting flanges 112, each adapted to be connected to the underside of an adjacent button deck to support the button deck filler 100 and particularly top part 105.

While in this version the hexagonal arrangement of gaming machines 10 is shown, other versions may include different arrangements. Button deck fillers 100 are particularly useful when gaming machines 10 are placed as depicted with their fronts at diverging angles, leaving a pie-shaped or wedge-shaped gap to be filled along the level of the button decks 102. As such, top part 105 is typically wedge-shaped as shown, but may be triangular in shape, viewing the upward surface as in FIG. 4. Further, button deck fillers 100 may be used with gaming machines 10 that have inward sloping sides toward the rear, such as the such as the adjacent edges that can be seen in FIG. 4, or may be used with gaming machines 10 having a rectangular or square footprint, in which case the top part 105 will typically extend further toward the back of the gaming machines in order not to leave an open gap. In this version, designed for a hexagonal arrangement of gaming machines, the top part 105 has a rear angle of 60 degrees, however this is not limiting and any suitable angle may be used to fill the gap between adjacent gaming machines.

Figure 9:
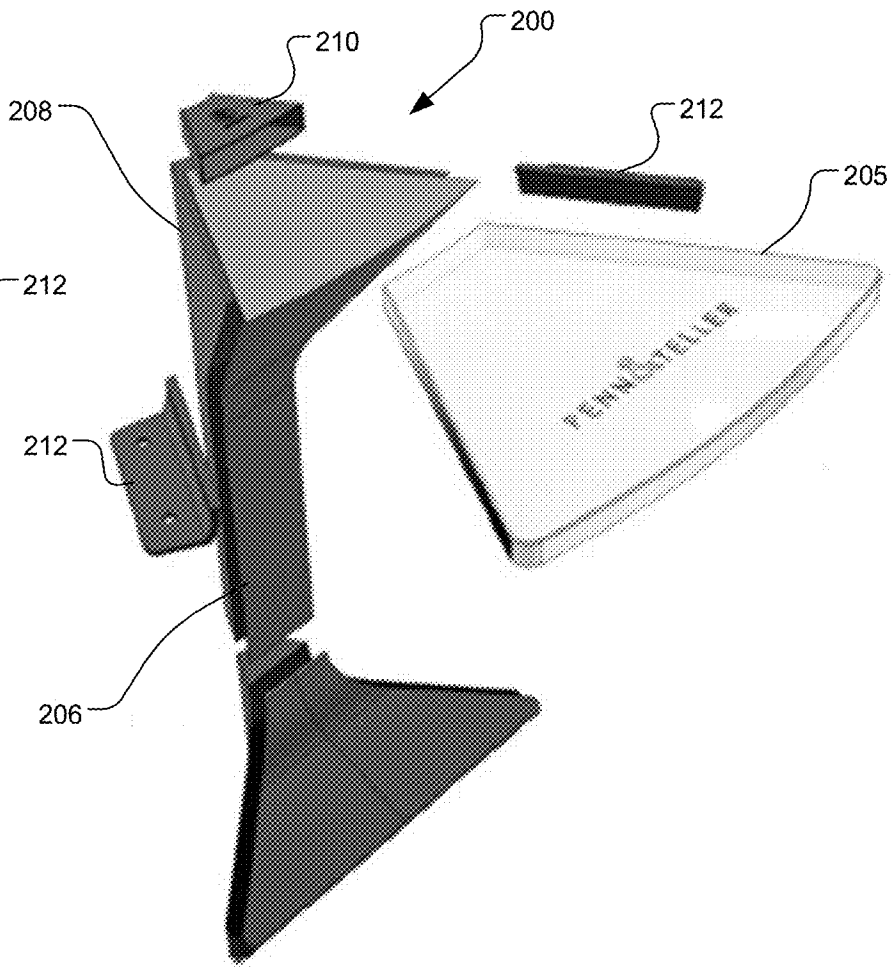
FIG. 9 is an exploded view in perspective of the alternate form of button deck filler shown in FIG. 8.
Figure 8:
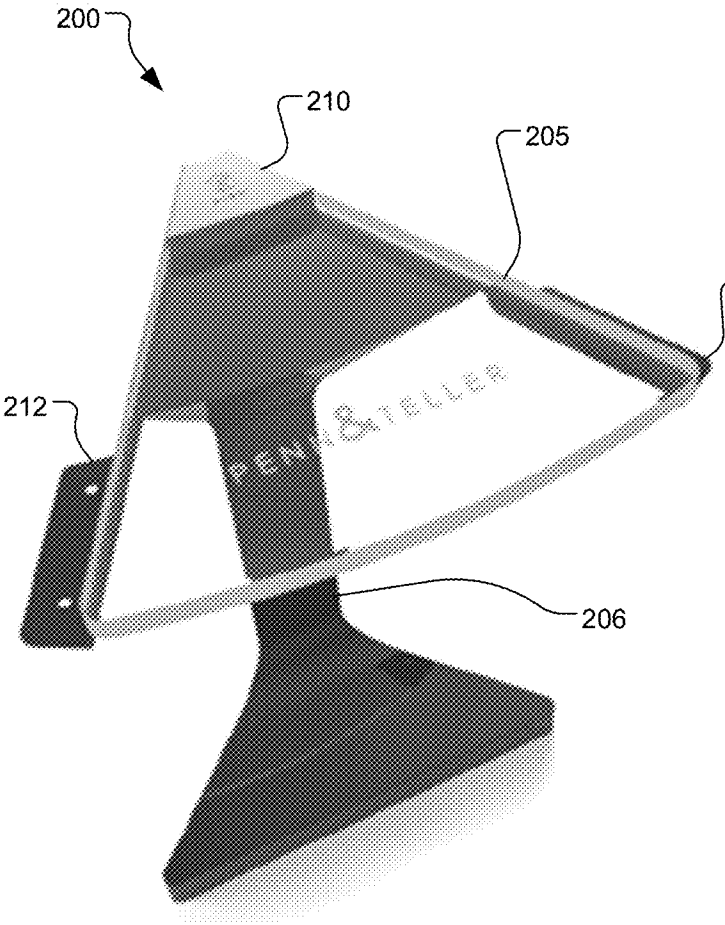
FIG. 8 is a view in perspective of an alternate form of button deck filler according to aspects of the invention.
Figure 10:
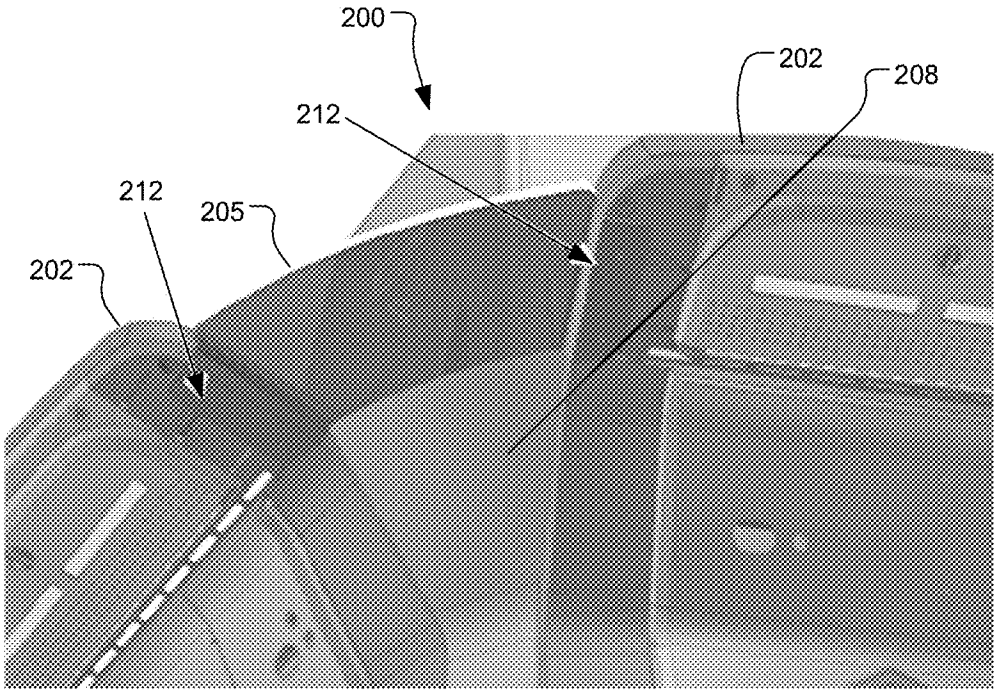
FIG. 10 is a view in perspective of the bottom of the button deck filler shown in FIGS. 8 and 9 as connected between to gaming machines.

FIGS. 8 through 10 show an alternative form of button deck filler 200 according to the invention. This alternative button deck filler 200 includes a transparent top part 205, a base 206, and an upper housing part 208 which in this form does not include a light source similar to light source 110. The feature may be employed together with the downward-facing light source of the prior embodiment. Button deck filler 200 also includes support flanges is 212 similar to support flanges 112 shown for button deck filler 100. The connection of these support flanges 212 is shown particularly in FIG. 10 connected to two adjacent button panels 202. Rather than a down lighting effect provided by light source 110 for button deck fillers 100, button deck filler 200 includes a light source 210 at the base of transparent top part 205. Light source 210 may include light elements such as adjustable RGB LEDs which direct light outwardly through transparent top part 205 to produce an edge lighting effect in the top part.

Additional embodiments may include both a down light such as light source 110 for providing ground effect lighting and a light source such as 210 to provide edge lighting or other lighting effects in the top part of the filler.

Figure 11:
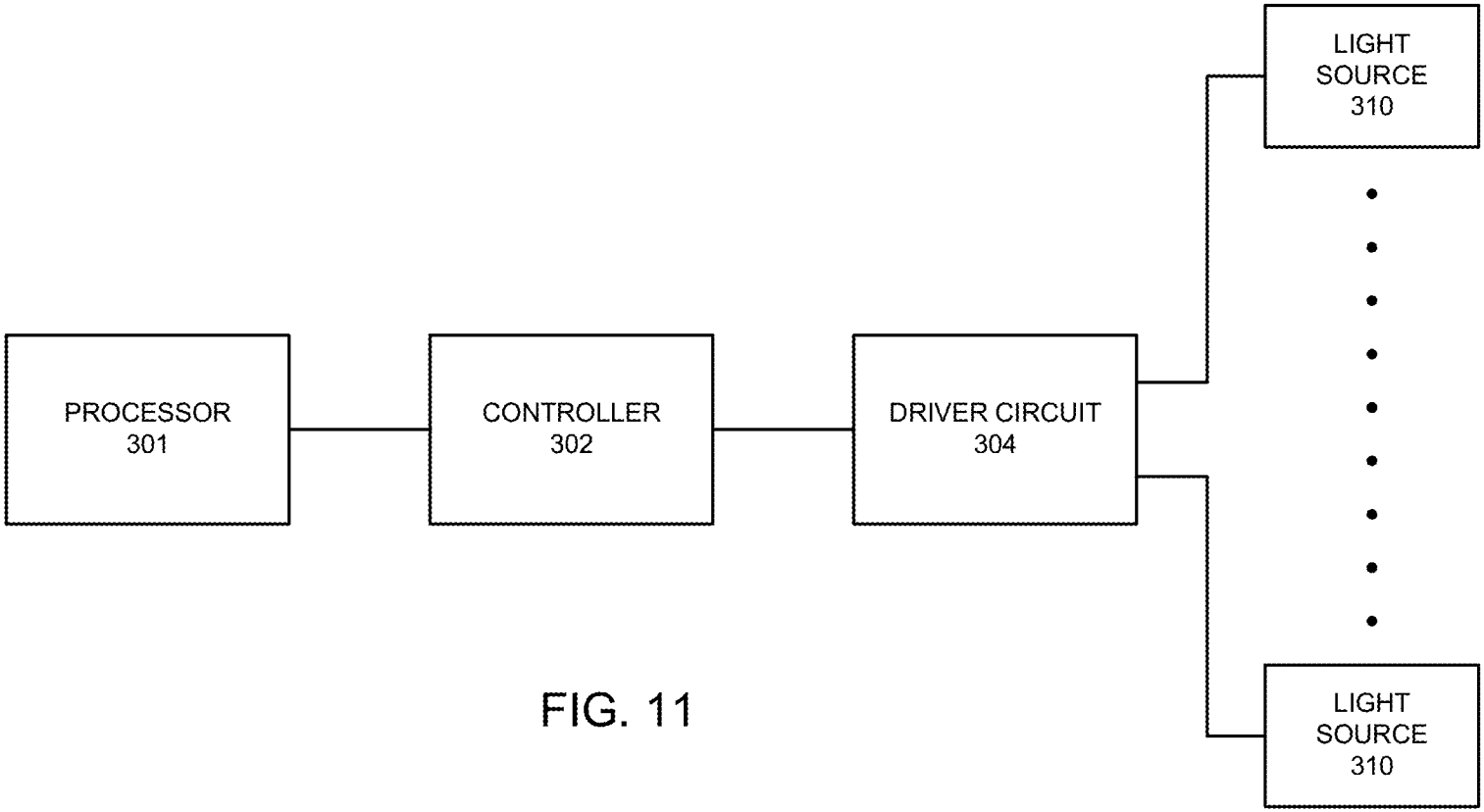
FIG. 11 is a schematic diagram of a control system for the light sources included in a button deck filler according to aspects of the invention.

FIG. 11 shows a schematic diagram of a light source control arrangement that may be used in connection with the light sources 310 in a button deck filler according to aspects of the present invention. Light sources 310 may include either one or both of the sources 110 and 210 described above. Ultimately control is preferably provided through a suitable processor 301 which may be a processor of an adjacent gaming machine or a processor associated with displays for a bank of adjacent gaming machines. The light effect control arrangement shown in FIG. 11 also includes a controller circuit 302 which is preferably connected by a suitable serial connection to processor 301. Controller 302 may be a suitable programmable logic controller which is adapted to send control signals to control a driver circuit 304. Driver circuit 304 in turn provides a suitable driving signal for the light sources, which are preferably RGB LED devices.

Figure 12:
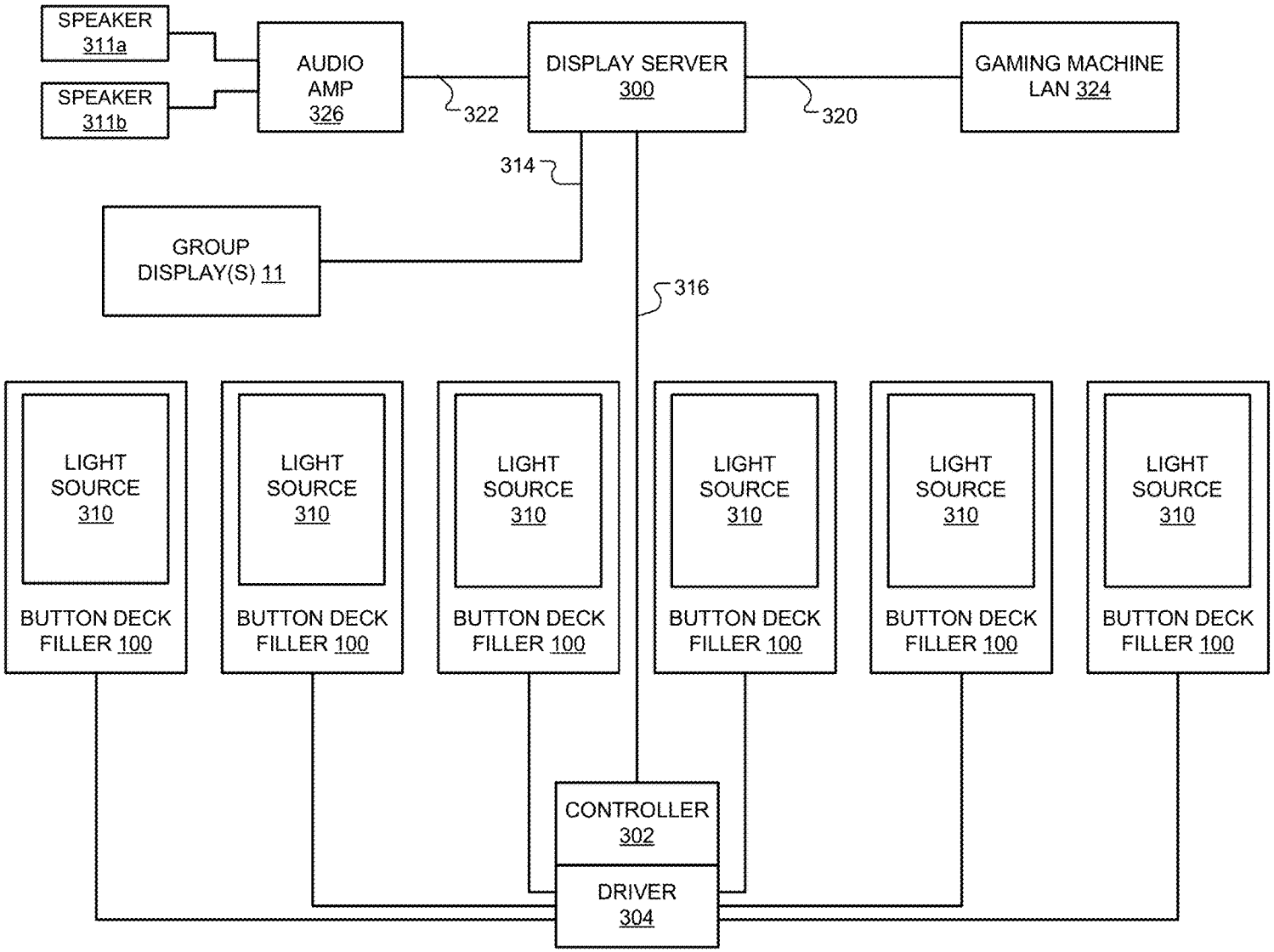
FIG. 12 is another schematic diagram of a control system including a multimedia server.

FIG. 12 shows, in block diagram form, various electronic components of shared multimedia system which are preferably housed in the structure shown in FIGS. 1 and 2 together with the button deck fillers 100. In particular, the depicted shared multimedia system includes a display server 300 connected for communication to a local area network 324. Display server 300 (which comprises a suitable data processing device including one or more processors) is also connected to communicate with a controller 302 which controls a driver circuit or arrangement of driver circuits 304 for driving light sources 310 associated with respective button deck fillers 100. Display server 300 is also connected to provide an audio signal to audio amplifier 326 which drives speakers 311*a* and 311*b*.

Display server 300 may have one or multiple video output ports 314, which may be DisplayPort compliant ports for example, for providing a video signal to group display(s) 11. Display 11 may be a round topper display such as display 11 of FIG. 1, or other display combinations dedicated toward providing multimedia presentation for the entire group or bank of gaming machines. (A single group display may require more than one signal port due to the size of the display.) The communication path 316 to controller 302 may comprise a serial communication path connected to a suitable serial output port 318 of display server 300. The communication link to the local area network is preferably an Ethernet link connected to an Ethernet port 320 of display server 300, while the audio output is provided through an audio output jack 322 associated with the display server. The gaming machine LAN 324 shown in FIG. 12 is included to indicate that all of the gaming machines 10 (FIG. 1, for example) are also connected via Ethernet in this example to display server 300.

Although the simplified schematic shown in FIG. 12 shows only a single connection from the driver 304 button deck filler 100, it will be appreciated that each button deck filler may include one or more light sources, and each light source may itself be divided up into separate lighting sections which are each separately controllable to provide lighting effects along each respective button deck filler 100.

The simplified schematic of FIG. 12 also omits power supplies which are necessary for supplying the appropriate operating power to the various illustrated electronic components. Display server 300 may comprise any suitable processing device capable of driving group display(s) 11 and light sources 310. In operation, display server 300 receives event messages that control multimedia events on group display 11, speakers 311, and light sources 310, and runs local programming to provide multimedia events. In response to events, display server 300 sends video, audio, or lighting control signals. Other multimedia fixtures associated with gaming machines 10 may also receive signals from display server 300.

It will be appreciated that the control circuit shown in FIG. 11 or FIG. 12, or another control circuit may be used to coordinate the lighting effects provided by button deck fillers according to the present invention with events at the adjacent gaming machines. The light sources may also be controlled independently of events at the gaming machines but coordinated such as by flashing, chase effects, and color changes. Instructions for defining the lighting effects may be provided remotely over gaming machine LAN 324. Instructions for activating the lighting effects may also be received over gaming machine LAN 324. In particular, gaming machines may send instructions to display server 300 to activate a particular lighting effect on one or more of light sources 310 in response to an event in a game at the particular gaming machine. Display server 300 may also activate lighting effects according to group events applicable to all gaming machines in the group and coordinated by display server 300.

As used herein, whether in the above description, the terms "comprising," "including," "carrying," "having," "containing," "involving," and the like are to be understood to be open-ended, that is, to mean including but not limited to. Also, it should be understood that the terms "about," "substantially," and like terms used herein when referring to a dimension or characteristic of a component indicate that the described dimension/characteristic is not a strict boundary or parameter and does not exclude variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Any use of ordinal terms such as "first," "second," "third," etc., in the following claims to modify an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention. For example, in some instances, one or more features disclosed in connection with one embodiment can be used alone or in combination with one or more features of one or more other embodiments. More generally, the various features described herein may be used in any working combination.

The invention claimed is:

1. A button deck filler assembly adapted to be connected between adjacent gaming machines, comprising:

a top portion adapted to, when installed, fill a span between respective button decks of adjacent gaming machines, the top portion comprising a transparent top part extending toward the front of the button deck filler and providing a transparent shelf through which light underneath the top portion can be seen;

a base portion below the top portion and adapted to, when installed, fill a span between the gaming machines; and a light source attached to the assembly and operable to produce a light effect visible as light emitting from the button deck filler assembly, the light source comprising an RGB adjustable light source mounted along an upper housing of the base portion and directed at a downward angle under the transparent top part.

2. The button deck filler assembly of claim 1, further comprising a driver coupled to the light source, and a controller coupled to the driver and operable to connect to a local area network, receive instructions from the network associated with the light effect, and in response, operate the driver to cause the light to produce the light effect.

3. The button deck filler assembly of claim 2, in which the controller is adapted to receive instructions to produce the light effect from the gaming machines.

4. The button deck filler assembly of claim 1, further comprising two supporting flanges, each having a first side adapted to be connected to the underside of an adjacent button deck to support the button deck filler and a second side adapted to be connected along a respective side of the top portion.

5. The button deck filler assembly of claim 1, wherein the top portion has a wedge shape adapted to fill the span between the button decks with the adjacent gaming machines placed with their front faces at a diverging angle.

6. A gaming machine assembly comprising:

a plurality of gaming machines each comprising an electronic display and a button deck extending below the electronic display at a front face of the gaming machine; and a plurality of button deck filler assemblies adapted to be connected between respective adjacent pairs of the gaming machines and comprising:

a top portion adapted to, when installed, fill a span between respective button decks of adjacent gaming machines, the top portion comprising a transparent top part extending toward the front of the button deck filler and providing a transparent shelf through which light underneath the top portion can be seen;

a base portion below the top portion and adapted to, when installed, fill a span between the gaming machines; and a light source attached to the assembly and operable to produce a light effect visible as light emitting from the button deck filler assembly, the light source comprising an RGB adjustable light source mounted along an upper housing of the base portion.

7. The gaming machine assembly of claim 6, in which the button deck filler assemblies further comprise a driver coupled to the light source, and a controller coupled to the driver and operable to connect to a local area network, receive instructions from the network associated with the light effect, and in response, operate the driver to cause the light to produce the light effect.

8. The gaming machine assembly of claim 7, in which the controller is adapted to receive instructions to produce the light effect from the gaming machines.

9. The gaming machine assembly of claim 6, in which the button deck filler assemblies further comprise two supporting flanges, each having a first side adapted to be connected to the underside of an adjacent button deck to support the button deck filler and a second side adapted to be connected along a respective side of the top portion.

10. The gaming machine assembly of claim 6, wherein each top portion has a wedge shape adapted to fill the span between the button decks with the adjacent gaming machines placed with their front faces at a diverging angle.

11. A button deck filler assembly adapted to be connected between adjacent gaming machines, comprising:

a top portion adapted to, when installed, fill a span between respective button decks of adjacent gaming;

a base portion below the top portion and adapted to, when installed, fill a span between the gaming machines;

further comprising two supporting flanges adapted to connect the top portion to adjacent button decks on either side, each having a first side adapted to be connected to the underside of an adjacent button deck to support the top portion;

a light source attached to the assembly and operable to produce a light effect visible as light emitting from the button deck filler assembly; and a driver coupled to the light source, and a controller coupled to the driver and operable to connect to a network, receive instructions from the network associated with the light effect, and in response, operate the driver to cause the light to produce the light effect.

12. The button deck filler assembly of claim 11, in which the controller is coupled to a local area network on which the gaming machines are coupled (EGM LAN), and adapted to communicate on the EGM LAN with the gaming machines and other network nodes.

13. The button deck filler assembly of claim 11, in which the controller is adapted to receive instructions to produce the light effect from one of the adjacent gaming machine.

14. The button deck filler of claim 11, in which the top portion comprises a transparent top part extending toward the front of the button deck filler and providing a transparent shelf through which light underneath the top portion can be seen.

15. The button deck filler assembly of claim 14, in which the light source is positioned behind the transparent top part and operable to provide light effects visible along the transparent top part.

16. The button deck filler assembly of claim 11, in which the light effect is visible through the transparent top part on a floor upon which the gaming machines rest.

17. The button deck filler assembly of claim 11, in which the light source is an RGB controllable light source mounted along an upper housing of the base portion and directed at a downward angle.

18. The button deck filler assembly of claim 11, in which the controller is coupled to a local area network on which the gaming machines are coupled (EGM LAN), and adapted to communicate on the EGM LAN with the gaming machines and other network nodes.

19. The button deck filler assembly of claim 11, wherein the top portion has a wedge shape adapted to fill the span between the button decks with the adjacent gaming machines placed with their front faces at a diverging angle.

* * * * *